US005558139A

United States Patent [19]

Snyder

[11] Patent Number: 5,558,139

[45] Date of Patent: Sep. 24, 1996

[54] LIQUID OXYGEN SYSTEM

[75] Inventor: Fred P. Snyder, St. Louis, Mo.

[73] Assignee: Essex Cryogenics of Missouri, St. Louis, Mo.

[21] Appl. No.: 388,342

[22] Filed: Feb. 13, 1995

[51] Int. Cl.[6] ..... B65B 1/30; B65B 31/00

[52] U.S. Cl. ..... 141/95; 141/18; 141/39; 141/82; 141/197; 128/201.21; 137/210; 62/50.1

[58] Field of Search ..... 141/2, 3, 4, 5, 141/7, 18, 21, 39, 82, 95, 197; 128/201.21; 137/210; 62/45.1, 48.1, 50.1, 50.2, 50.4, 331

[56] References Cited

U.S. PATENT DOCUMENTS

| | | | |
|---|---|---|---|
| 2,919,834 | 1/1960 | Rugeley et al. | 222/52 |
| 2,943,454 | 7/1960 | Lewis | 62/51 |
| 2,945,354 | 7/1960 | Moskowitz | 62/50.2 |
| 2,968,163 | 1/1961 | Beckman | 62/51 |
| 2,988,002 | 6/1961 | Dodd | 103/7 |
| 3,001,375 | 9/1961 | Tauscher | 62/51 |
| 3,018,635 | 1/1962 | Keckler | 62/55 |
| 3,021,684 | 2/1962 | Berck | 62/49 |
| 3,123,981 | 3/1964 | Carney et al. | 62/51 |
| 3,707,078 | 12/1972 | Cramer | 62/51 |
| 4,018,582 | 4/1977 | Hinds et al. | 62/50 |
| 4,211,086 | 7/1980 | Leonard et al. | 62/50 |
| 4,625,753 | 12/1986 | Gustafson | 137/202 |
| 4,649,968 | 3/1987 | Berrettini | 141/95 |
| 5,107,898 | 4/1992 | Keeney | 137/871 |
| 5,165,246 | 11/1992 | Cipolla et al. | 62/47.1 |
| 5,246,045 | 9/1993 | Clothier et al. | 141/95 |

*Primary Examiner*—Henry J. Recla
*Assistant Examiner*—Steven O. Douglas
*Attorney, Agent, or Firm*—Kalish & Gilster

[57] ABSTRACT

A system for compactly safely storing and delivering oxygen has a plurality of elements interconnected by fluid lines and includes a liquid oxygen tank, a filler valve and a vent valve. The new system also includes a differential pressure gauge located between and in communication with the fill valve and the vent valve to permit monitoring the pressure differential in the system so that selective adjustments can be made in a timely and controlled manner to maintain the pressure within the system during filling at an optimum level. The system also has at least one pressure relief valve, a heat exchanger, a fluid pressure regulator, an oxygen flow control outlet and a phase selector valve, to thereby permit automatic selection as a function of pressure of whether oxygen supplied from the tank to the heat exchanger will be supplied as either a liquid or a gas. The system elements are all sized and arranged in relation to one another so as to provide a light-weight, compact system for safely storing and delivering oxygen which is suitable for use by a home-bound patient as well as in a movable vehicle, and otherwise where safety, weight and size are of concern.

22 Claims, 4 Drawing Sheets

LIQUID OXYGEN SYSTEM

BACKGROUND AND SUMMARY OF THE INVENTION

The present invention relates generally to the field of oxygen storage and delivery systems, and, more particularly, to a system for safe, compact storage of liquid oxygen especially for safe, convenient transport in a vehicle such as a helicopter or an ambulance for ultimate delivery of gaseous oxygen to a patient.

Previously, land ambulances usually carried compressed gas cylinders, commonly referred to as "H" cylinders, a well-known type of steel tank, to store oxygen under high pressure for various uses, particularly in hospitals and manufacturing industry. Typically, oxygen is contained in such tanks at approximately 2,000 psig. These conventional tanks are available in different sizes, but the most commonly used variety weigh approximately 125 pounds and occupy a space at least approximately five feet high and about nine inches in diameter.

Due to their weight and elongated form conventional compressed gas oxygen cylinders are difficult and even dangerous to handle. These cylinders are so heavy as to affect the center of gravity of the ambulance. Furthermore, there exists the significant risk that a tank can be damaged in an accident, resulting in an explosion and turning pieces of the highly pressured cylinder into high speed projectiles.

In helicopter ambulances the weight and explosion concerns caused by compressed gas cylinders cannot be ignored. When liquid oxygen is used in aircraft the parameters of size, weight and explosion hazard acquire increased importance. As will be shown herein the new liquid oxygen system which has been developed with air ambulances in mind has beneficial features which make it equally useful in land ambulances. Accordingly, the new system will sometimes be referred to herein as the ALOXS (ambulance liquid oxygen system, or LOXS), for convenience.

Orbitally shaped oxygen tanks have been used for some time in military and commercial aircraft cryogenic systems for storage and delivery of oxygen to crew members. These strong round metal tanks generally have multiple walls and contain oxygen at approximately only 200 psig and thus are inherently safer than the compressed gas cylinders just described. They are also much lighter than compressed gas cylinders containing approximately the same volume of oxygen. For purposes of comparing weight and oxygen containing capacity of the new system with the above-mentioned H cylinders, as well as with other known oxygen cylinders, the following table is provided:

Approximate Weight And Capacity Comparison
ALOXS Versus High Pressure Cylinders
ALOXS Weight: 38.5 lbs. empty, 60.0 lbs. full
ALOXS Capacity: 6580 liters of gaseous oxygen @ STP

| Cylinder Type | Full Weight of Cylinder Lbs. | Oxygen Capacity of Cylinder Liters | Equivalent Number of Cylinders | Weight of Equivalent Number of Cylinders |
|---|---|---|---|---|
| D | 10.1 | 360 | 18.3 | 184.8 |
| E | 13.8 | 625 | 10.5 | 144.9 |
| M | 72.9 | 3,029 | 2.2 | 160.4 |
| G | 111.5 | 5,300 | 1.2 | 133.8 |
| H | 125.3 | 6,246 | 1.1 | 137.8 |

Another hazard exists every time a cylinder is changed out. Should a high pressure cylinder be knocked over and the valve broken off a missile would be created which could injure persons nearby and damage equipment and facilities.

An additional concern in the area of safety relates to further potential injury to personnel. A fully charged H cylinder weighs well over 145 pounds. Most "EMS" (emergency medical service) personnel are already at high risk of back injury from lifting patients and do not need additional such stresses imposed on them. Ordinarily, the high pressure gas cylinder must be unloaded from the ambulance and a charged (full) cylinder loaded on, often without the aid of a hoist, winch, or dolly, every time the oxygen system needs to be resupplied.

The design of the ALOXS is such that it may be permanently installed on the emergency medical vehicle. For example, one extremely well protected position is beneath the module inside the chassis frame. An alternative position is within one of the equipment compartments of the module. This exposes the ALOXS to the potential for impact damage discussed above, but the ALOXS is inherently able to withstand such stress without creating a safety hazard.

Firstly, the new system is a low pressure system, 235 psig maximum, as opposed to the 2000 psig of a high pressure gaseous oxygen system; so the potential for explosion with the ALOXS is substantially non-existent.

Secondly, the ALOXS tank is fabricated of "304" stainless steel which is much more ductile and therefore better able to withstand shock and deformation than the alloy steel used in the manufacture of high pressure gas cylinders.

And finally, liquid oxygen is inherently safer than gaseous oxygen for most applications, and is definitely safer in this case. Should an ALOXS tank be penetrated, the contained liquid oxygen would merely spill to the ground, vaporize, and drift harmlessly away. By contrast, should a high pressure oxygen cylinder be penetrated, there would be a high velocity release of gaseous oxygen. It is common knowledge that many fires have been initiated and promulgated by high velocity gaseous oxygen flow.

When the ALOXS is mounted to the ambulance by either method described above there would be no lifting or hoisting of equipment to fill the system. The only lifting required would be to raise the fill hose to connect to the fill valve on the ambulance.

It should be noted that the ALOXS can be configured so that the tank can be easily and quickly removed from the ambulance for filling if, due to some unusual circumstance, that needed to be done. However, should this be the case, personnel would be working with only up to approximately 60 pounds with the new system, as opposed to approximately 145 pounds with a conventional high pressure gas system.

Thus, it has become apparent that there is a need for a safe, convenient system for storing and supplying oxygen particularly for use in emergency care vehicles such as helicopters and ambulances, which system is light weight relative to known oxygen storage and delivery systems and economical to manufacture and operate. The new oxygen system described below provides all these features and is well adapted for home health care and hospital use in addition to being ideally suited for aircraft life support. It has been found that orbital oxygen tanks can form part of a new liquid oxygen system to transport oxygen to patients by either land or air in a safe, facile and convenient manner.

The ALOXS described and shown in schematic form herein is a 6,580 gaseous liter capacity oxygen system which contains and stores oxygen in the form of 8.5 liters of liquid and supplies gaseous oxygen, on demand, at a nominal pressure of 50 psig and a minimum flow rate of 100 liters per minute at a temperature within 20 degrees Fahrenheit of ambient.

The nominal operating pressure of the ALOXS is 70 psig. As such, with the incorporation of the pressure regulator, the system supplies oxygen at 50 psig, the standard operating pressure of medical oxygen equipment.

The ALOXS contains a capacitance type quantity gauging system which provides users with a way to monitor the content of the storage tank. Tank contents are displayed by a quantity indicator having a light emitting diode display.

The ALOXS utilizes the saturated liquid principle of operation as opposed to the pressure buildup scheme. A saturated liquid system is more reliable since it utilizes fewer and more reliable components than those used in a pressure buildup system.

The new ALOXS ordinarily includes several specific features especially worth noting. For example, the quantity indicator includes a full level indicator circuit which provides servicing personnel an audible or visual signal when the tank full level has been attained. Also, during preliminary market survey work it became apparent that it would be beneficial to users if the system could accommodate a variety of filling pressures so that the system could be filled from a variety of sources such as a captive supply, a commercial industrial gas supplier, a home health care gas supplier, or from a hospital liquid oxygen system.

These unique features lend the ALOXS significant advantages in terms of operation, serviceability, durability, reliability, and safety when compared to other potentially competitive systems such as modified home health care units, industrial gas supply equipment, or aircraft life support systems.

The cost of oxygen varies from region to region depending upon proximity to a production plant, the local competitive situation and the like. It should be noted that because of the requirement that an ambulance have a minimum quantity of oxygen on board before responding to a call the usual H cylinder must sometimes by replaced when its pressure has been depleted to approximately 800 psig. Thus, approximately 20% of an H cylinder's volume is commonly paid for but not used. This expense can be obviated with the new system.

The new system is ideally compatible with filling pressures ranging from about 70 to about 235 psig and incorporates a filling scheme which accommodates these wide variations of pressure and allows the system to be filled from essentially any source. It incorporates a unique arrangement of valves and gauges so that the pressure difference across the system can be maintained at a constant level. A differential pressure gauge is critically added across the fill and vent circuits of the system and a needle valve is placed in the outlet of the vent circuit for controlling the pressure difference, to keep it at a constant level, as monitored by the differential pressure gauge, irrespective of the absolute filling pressure.

Thus, it is among the several advantages of the present invention that the new oxygen system has a fraction of the weight, significantly more "breathing" capacity, costs much less per cubic foot of oxygen and saves about three cubic feet of space, as compared to the conventional H cylinders.

It is further among the advantages of the present invention, having the features indicated, that it meets criterion for use in emergency medical service helicopters, while also being compatible with known home health care and hospital liquid oxygen equipment as well as being capable of being filled from a variety of sources.

Accordingly, in keeping with the above goals, the present invention is, briefly, a system for compactly safely storing and delivering oxygen which system has a plurality of elements interconnected by fluid lines and includes a reinforced, metal, orbitally-shaped tank which receives and contains oxygen to be stored as a liquid and delivered by the system to an end user, a filler valve in communication with the tank for providing oxygen from a main source thereof to the system, and a vent valve connected to the liquid oxygen tank for selectively releasing oxygen from the system. The new system also includes a differential pressure gauge located between and in communication with the fill valve and the vent valve to permit an operator of the system to thereby monitor the pressure differential in the system so that selective adjustments can be made in a timely and controlled manner to maintain the pressure within the system during filling at an optimum level. The system also has at least one pressure relief valve between and in communication with the oxygen tank and the vent, to thereby release pressure from the system as necessary to maintain the desired temperature and pressure conditions within the system, a heat exchanger in communication with and between the liquid oxygen tank and a pressure regulator and a fluid pressure regulator in communication with and between the heat exchanger and an oxygen flow control outlet. The system further includes a flow control outlet by which flow of oxygen from the system to an end user can be controlled, and a phase selector valve disposed in line between and in communication with the liquid oxygen tank and the heat exchanger, to thereby permit the system to select as a function of pressure whether oxygen supplied from the liquid oxygen tank to the heat exchanger will be supplied as either a liquid or a gas, the tank, filler valve, vent valve, differential pressure gauge, at least one pressure relief valve, supply heat exchanger, pressure regulator and phase selector valve all being sized and arranged in relation to one another so as to provide a light-weight, compact system for safely storing and delivering oxygen which is suitable for use by a home-bound patient as well as in a movable vehicle, and otherwise where safety, weight and size are of concern.

The invention further includes the above-mentioned features in combination with an emergency medical transport vehicle.

Further advantages of the invention will be in part apparent and in part pointed out hereinbelow.

BRIEF DESCRIPTION OF THE DRAWINGS

Throughout the drawings like parts are indicated by like element numbers.

DESCRIPTION OF PRACTICAL EMBODIMENTS

With reference to the drawings, 10 generally designates a liquid oxygen storage and delivery system constructed in accordance with and embodying the present invention. FIGS. 1–4 illustrate system 10 in an assembled or at least partially assembled condition, whereas FIG. 5 schematically represents the arrangement of most elements of system 10, except the cage or housing 12 which completely contains the system as a conveniently useful compact unit. For clarity and simplicity of the figures, not all elements are shown and/or labeled in every figure.

Figure 1:
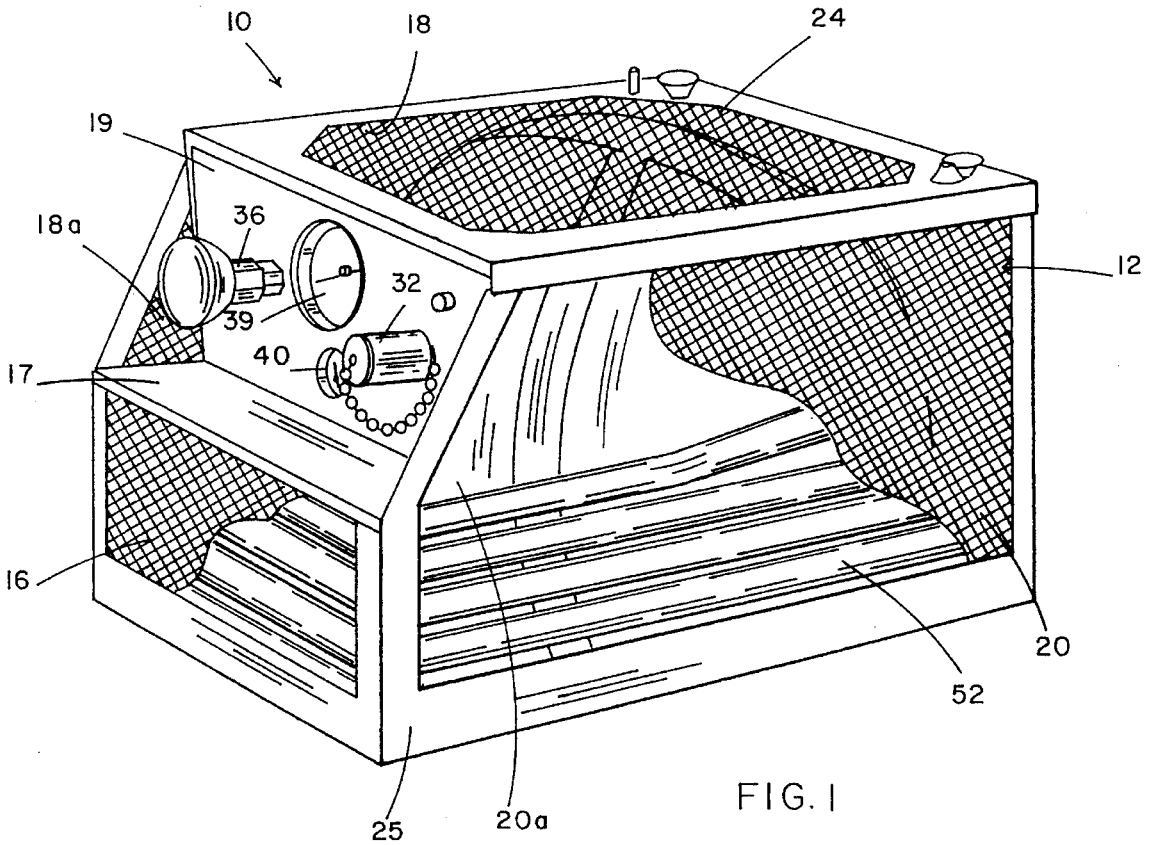
FIG. 1 is a perspective view, partially broken away, of a liquid oxygen storage and delivery system constructed in accordance with and embodying the present invention.
Figure 2:
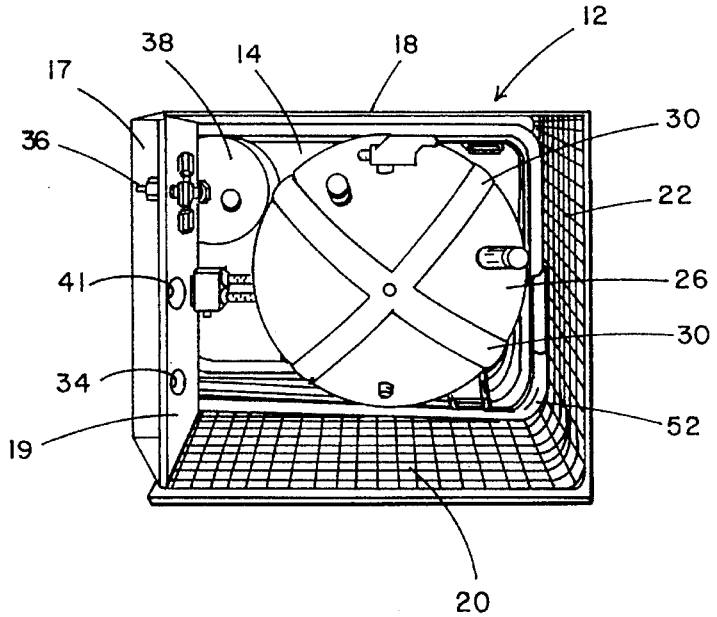
FIG. 2 is a top perspective view of the system of FIG. 1, with the top screened cover and certain valves removed for clarity.

Housing 12, as shown in FIG. 2, includes a solid floor 14 formed of aluminum sheeting in a preferably generally rectangular shape, upwardly from which rise four substantially vertical side walls which are preferably formed of perforated or expanded metal, or screening, and which interconnect with one another to form an open-topped enclosure for receiving the various operative elements to be described of system 10. Front side wall 16 is shorter than the other three side walls, being approximately one half the height of the other walls. Front wall 16 of housing 12 extends between its left and right ends where it intersects and is connected to left and right side walls 18, 20 (from the user's perspective, facing the controls at the left of FIG. 1), respectively.

FIG. 1 illustrates that front wall 16 extends substantially vertically upwardly and terminates in an upper edge which intersects and connects to a substantially horizontally disposed narrow rectangular shelf 17. Shelf 17 extends rearwardly between walls 18, 20 until it intersects and connects to a substantially vertically positioned control panel 19 to which various valves and gauges (to be described) of system 10 are forwardly mounted. The back surface of panel 19 is shown in FIGS. 2 and 4 to clarify the relative positioning of elements connected thereto. Thus, left and right side walls 18, 20 of housing 12 extend forwardly farther at their respective bottom edges than at their top edges and each have a rearwardly and upwardly sloped front upper "corner" which results in corresponding triangular wall areas 18*a*, 20*a* extending forwardly on either side of the forwardly protruding controls to protect them from sidelong impact.

Side walls 18, 20 are otherwise substantially rectangular and extend rearwardly, away from the user, parallel to one another and intersect at their rearwardly directed ends and connect there to respective left and right ends of preferably rectangular back side wall 22. Side walls 18, 20, and rear wall 22 are all desirably of the same height, so that screened metal cover of lid 24 sits flat and generally horizontally on their corresponding top edges when system 10 is disposed in its preferred upright, operative position, as illustrated in FIG. 1.

The joints of all side walls with one another, as well as with floor 14, are reinforced with preferably welded metal strips or sections of angle, as shown for example in FIG. 1 at 25, for strength and stability of housing 12. The outer edges of lid 24 are similarly reinforced by such metal strips, which are desirably formed at the side and back edges with a depending lip to overlap outwardly of the top edges of left side wall 18, right side wall 20 and rear wall 22, to prevent forward or sideways slippage of lid 24.

Figure 3:
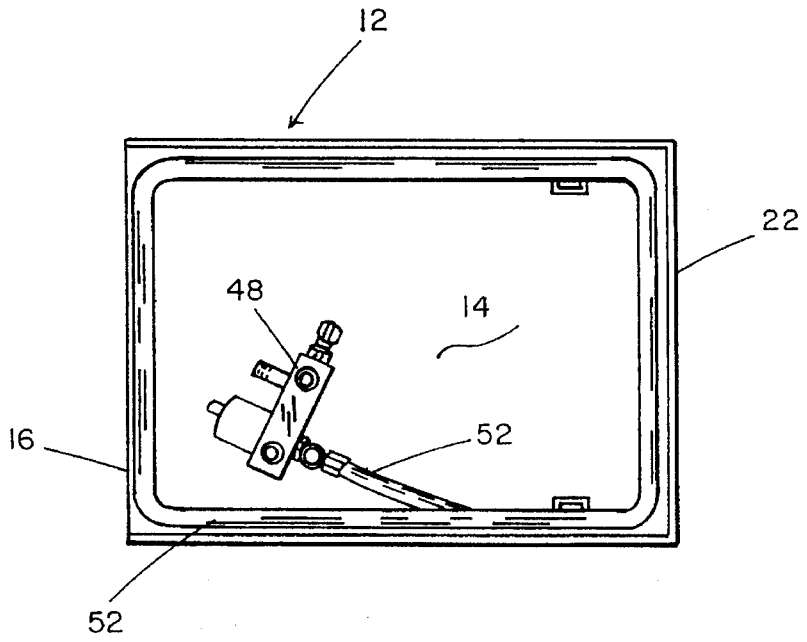
FIG. 3 is a top plan view of the system of FIG. 1, with the cover, front panel and portions of the internal elements removed for clarity.
Figure 4:
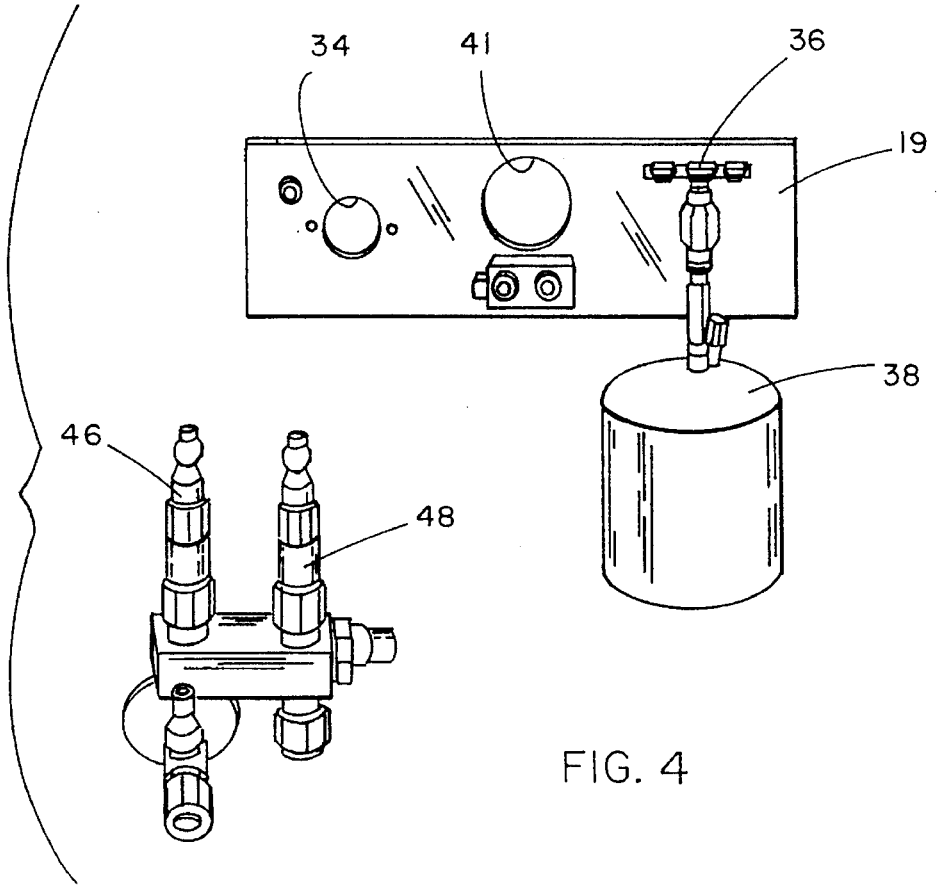
FIG. 4 is an exploded view of some of the internal elements of the system of FIG. 1 from a rear perspective and removed from the housing for clarity.
Figure 5:
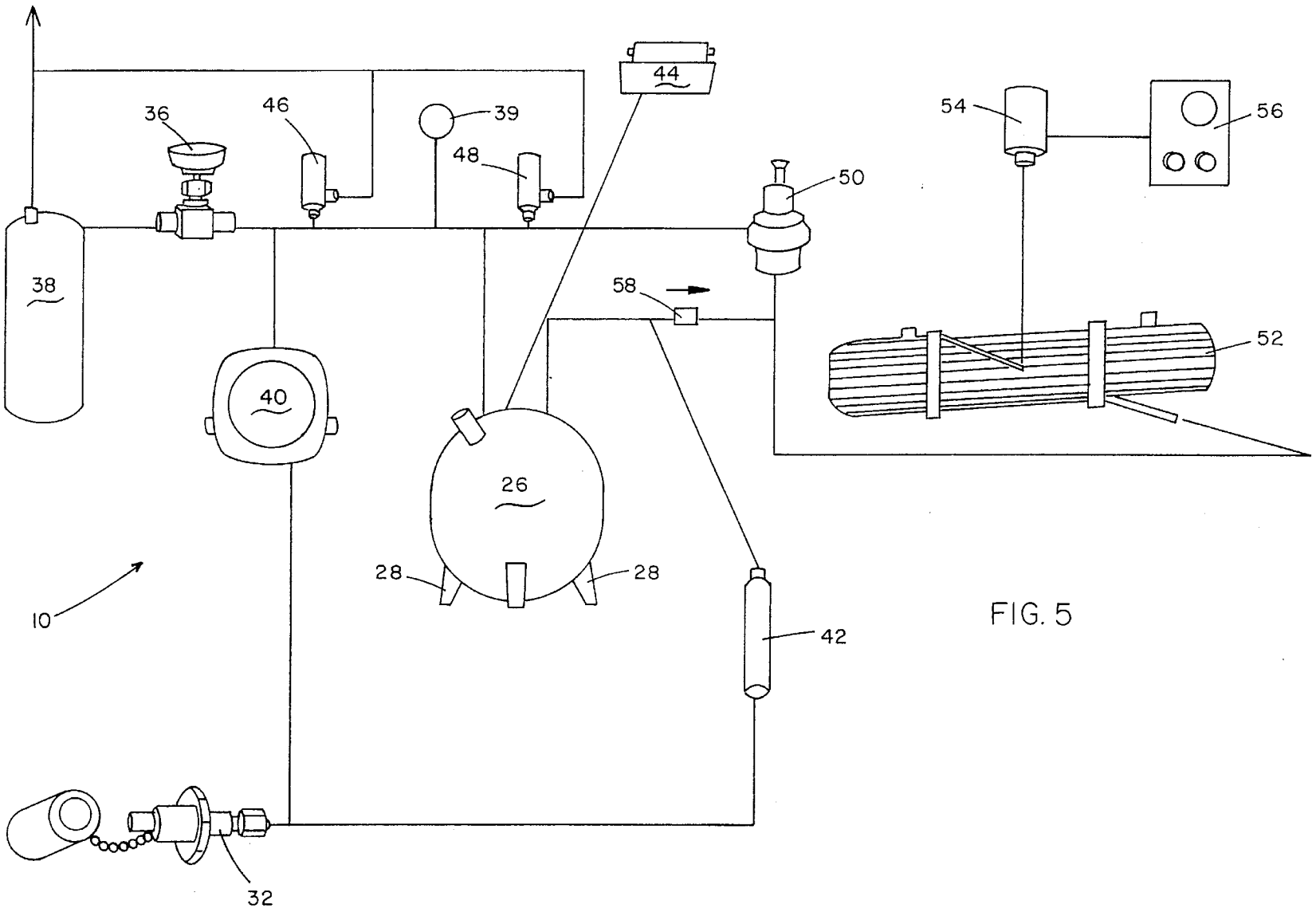
FIG. 5 is a schematic diagram of the system of FIG. 1 with the various elements thereof shown labeled.

FIGS. 2, 3 and 4 illustrate the arrangement of elements of LOX system 10 within housing 12. For clarity and simplicity of the drawings, various different elements are omitted from each of these views. However, all internal elements of the system are illustrated and labeled in their proper orientation to each other, schematically, in FIG. 5. It is to be understood that each of the individual system elements, such as the various valves and gauges, for example, are of known types. Thus, great detail in their individual descriptions will be avoided. Also, it is to be understood that the fluid lines and connections between various system elements are of known varieties or equivalents thereof. However, the specific arrangement of system 10 elements, as shown and described hereafter, is considered to be heretofore entirely unknown.

A preferably metal, orbitally-shaped liquid oxygen ("LOX") tank 26 is seated within housing 12 on floor 14, generally toward the rear thereof. Tank 26 desirably has four short legs 28 for most stable positioning and is provided around its outer surface with metal straps 30 for increased strength.

Oxygen tank 26 is connected by conventional fluid lines to a fill valve 32 which in turn connects system 10 by additional conventional fluid lines to a main source of oxygen, not shown. Fill valve 32 is preferably mounted through an aperture 34 in front panel 19, toward the right side thereof, as shown in FIG. 1. Shown at the left side of control panel 19 there is mounted a preferably manually operable vent valve 36. Vent valve 36 passes through panel 19 and connects to an overflow reservoir, or vent accumulator, 38 which receives excess oxygen from overfilling of tank 26. Valve 36 permits selective release of gaseous oxygen from tank 26 as desired or necessary via a fluid line such as indicated in phantom at 21 in FIG. 7.

The pressure in tank 26 is monitored visually by tank gauge 39, shown in FIG. 1, and which is mounted through an opening 41 in panel 19.

A differential pressure gauge 40 is also seated in the front facing control panel 19, and is positioned so as to be clearly visible to an operator of system 10. A key feature of the invention is that this differential pressure gauge 40 is connected "in-line" between fill valve 32 and vent valve 36 for optimal monitoring and control of pressure in system 10. More specifically, and as shown most clearly in FIG. 5, differential pressure gauge 40 is connected to the circuit in a position before check valve 42 (in the fill line) and after the high pressure relief valve 46 (in the vent line). Differential pressure gauge 40 is critical for monitoring pressure in system 10 during filling from a main source of oxygen. This monitoring is especially important when the main source supplies oxygen to the new system at a relatively high pressure. By contrast, tank pressure gauge 39 provides a reading of oxygen pressure only in tank 26 and may be useful at any time the system is in use.

The specific arrangement of fill and vent valves and pressure gauges shown on panel 19 in FIG. 1 is desirable for its ready access and convenient layout. However, other arrangements of these controls and mounting of such in a different location on system 10 may suffice. Also, as shown in FIG. 5, tank pressure gauge 39 is connected in the fluid circuit between high pressure and low pressure relief valves 46, 48, respectively. However, it may just as well be positioned in line in the fluid circuit between low pressure valve 48 and phase selector valve 50.

A fill check valve 42 is positioned in line between fill valve 32 and tank 26 to prevent back flow of liquid oxygen during filling of tank 26. The volume of the contents of LOX tank 26 can be monitored at all times by a contents gauge 44 which is connected via a conventional capacitance probe and connecting electronic circuitry to the tank and which is preferably disposed for facile reading on the EMT (emergency medical technician) panel 57 (shown, for example, in FIG. 7). Gauge 44, as seen in FIG. 5, may be of any known type, such as the conventional dial, a light bar, or of an electronic, digital readout variety (e.g., "LED") such as that indicated at 44 in FIG. 5, as desired.

Preferably, a high pressure relief valve 46 and a low pressure relief valve 48 are disposed in line between the vent valve and the liquid oxygen tank 26 and are also connected to a phase selector valve 50 which controls whether the system is operating in the vapor phase or the liquid phase. If necessary, however, the system can function with only one pressure relief valve.

Phase selector valve 50 is preferably of the automatic pressure response type which is open when the system pressure is greater than 70 psig to remove the oxygen vapor head in tank 26 and then closed when the system pressure is 70 psig or less. Phase selector valve 50 is positioned in line between tank 26 and a supply heat exchanger 52, the coils of which are seen in FIGS. 1, 2 and 3 to be formed around the inside lower perimeter of housing 12 so as to pass around the base of LOX tank 26.

A pressure regulator 54 is positioned in the oxygen line between the heat exchanger 52 and a flow control oxygen outlet panel 56 by which the oxygen is delivered for use in the usual manner; as, for example, to a patient (not seen). Optionally, a pressure differential check valve 58 may be disposed in line between tank 26 and the supply heat exchanger 52 in order to increase resistance and assure vapor flow rather than liquid flow when the phase selector valve is open. Check valve 58 may be set, for example, at approximately 2 to about 3 psi.

So constructed, system 10 permits a degree of flexibility of use that has previously been unknown in liquid oxygen systems. As explained further hereafter, this is due in part to the ability of the system to be filled from virtually any known oxygen source, and in part to the safety of the low pressure at which the oxygen tank is maintained. Furthermore, system 10 is quite adaptable in the oxygen delivery options available that it offers. Thus, for example, when operating in the vapor phase mode at more than 70 PSIG the gaseous oxygen in system 10 passes from tank 26 through the phase selector valve 50, then through the supply heat exchanger 52 and via the pressure regulator 54 to the flow control oxygen wall outlet 56 where it is supplied as a gas to the user.

However, if there is particularly high demand, in addition to the flow just described, additional oxygen may be supplied as a liquid directly from tank 26, through check valve 58, to the supply heat exchanger 52, converted to gaseous oxygen and then it continues as just described, through pressure regulator 54, and then to the patient or other recipient end user as a gas via flow control outlet 56.

When in the normal liquid phase operating mode, at 70 psig or less, oxygen passes as a liquid from tank 26, through check valve 58, to supply heat exchanger 52 and on as usual and as shown via pressure regulator 54 to flow control outlet 56.

When in the fill/vent mode, liquid oxygen system 10 receives oxygen from a main source (not shown) as a liquid. However, to vent, the excess oxygen is released as a high pressure gas (vapor).

Figure 7:
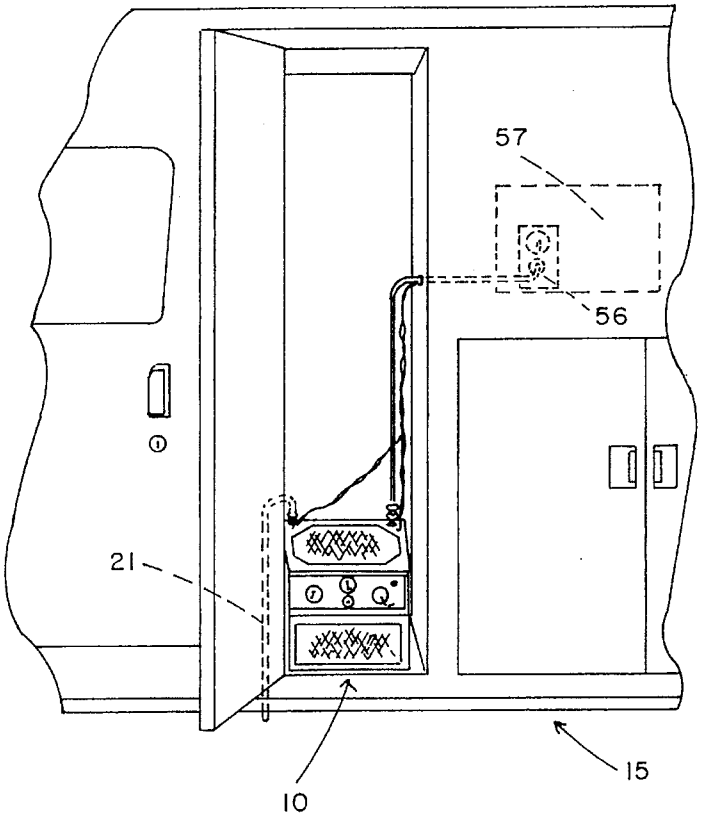
FIG. 7 is an elevational view of the system of FIG. 6 with the emergency medical vehicle shown partly broken away and with some connections to the system shown in phantom.
Figure 6:
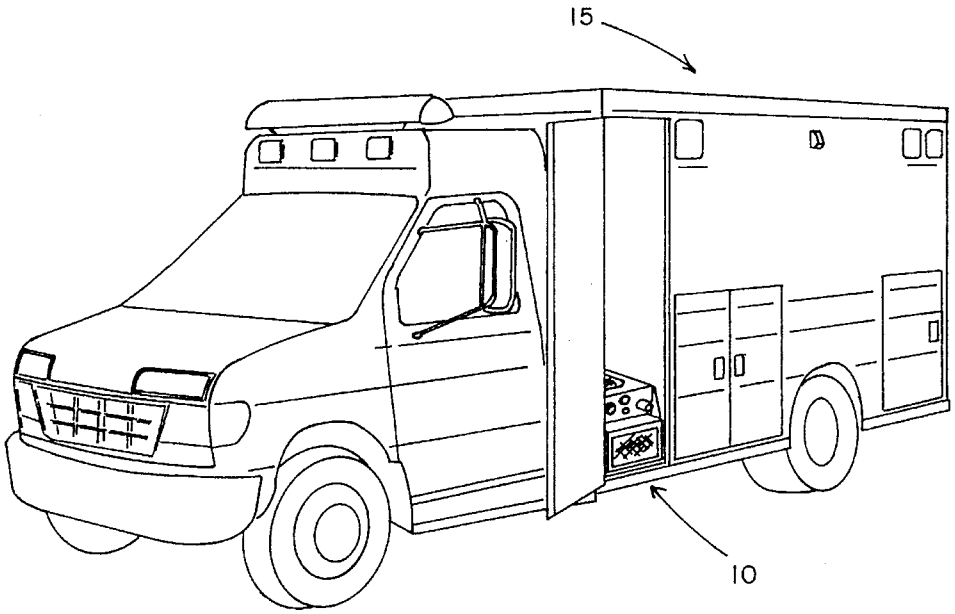
FIG. 6 is a perspective view of the system of FIG. 1 shown mounted on an emergency medical vehicle.

FIGS. 6 and 7 illustrate a convenient mounting arrangement of the new liquid oxygen system 10 within a land ambulance, generally designated 15. The mounting arrangement shown is offered only as an example. As the entire system 10 requires only 1.78 cubic feet of space; i.e., only about 17.5" by about 13.5" by about 13.0", it can be readily seen that a number of convenient mounting sites for the new LOX system can found in any known emergency medical vehicle, regardless of whether the vehicle is of a type used on land, water or by air. Further, the extreme light weight of system 10, only about 60 pounds when full, will not cause any substantial influence on the center of gravity of the emergency vehicle.

Further regarding the advantages and specifications of the ALOXS 10 and elements thereof, the structural integrity of the ALOXS orbital tank 26 is unique to the commercial arena as compared to the high pressure cylinders previously described. The standard for the ALOXS requires that the tank withstand, without damage, a vibratory load of 1.5 g's in each direction; a basic design shock load of 20 g's in each direction; steady state acceleration loads of 4 g's laterally in all four directions, 9 g's downward, and 3 g's upward; and that the tank remain in place and lose no contents when subjected to crash loads of 60 g's in each of 6 directions.

The weight of the ALOXS 10 when tank 26 is empty is about 38.5 pounds. The weight of the ALOXS when tank 26 is filled to capacity with 6,580 liters of gaseous oxygen (8.5 liters of liquid oxygen) is about 60.0 pounds. Comparisons of the weight and capacity of the ALOXS 10 and various high pressure cylinders are contained in the table provided above, in the Background of the Invention. Those ALOXS parameters are in keeping with the system 10 being constructed with components of the preferred dimensions as listed below.

Sample Component Dimensions

| Equipment Item (Element #) | Outline Dimensions Inch |
|---|---|
| LOX Tank (26) | 12.25 dia × 12.70 h |
| Fill Valve (32) | 1.64 dia × 4.00 lg |
| Fill Check Valve (42) | .62 hex × 3.00 lg |
| Phase Selector Valve (50) | 2.26 dia × 3.56 lg |
| Vent Valve (36) | 2.13 lg × .83 wd × 3.30 h |
| Vent Accumulator (38) | 4.60 dia × 7.03 h |
| Differential Pressure Gauge (40) | 1.50 square × 1.38 dp |
| Supply Heat Exchanger (52) | 17.00 lg × 13.00 wd × 8.50 h |
| Pressure Regulator (54) | 2.25 dia × 3.88 lg |
| Flow Control Oxygen Outlet (56) | 5.06 h × 3.25 wd × 1.50 dp |
| Low Pressure Relief Valve (48) | 1.00 dia × 3.00 lg |
| High Pressure Relief Valve (46) | 1.00 dia × 3.00 lg |
| LOX Contents (vol.) Gauge (44) | 5.25 wd × 2.65 h × 1.75 dp |

Configured as shown in FIG. 5, and described above, ALOXS 10 provides a minimum flow rate of 100 liters per minute. However, the ALOXS can be readily modified to provide higher flow rates, if required, to support specialty equipment or a special patient need.

The maximum flow rate from a liquid oxygen system is driven by the heat transfer capacity of the heat exchanger not the maximum flow rate from the tank. The liquid oxygen tank 26 can provide a flow many times the 100 liters per minute flow rate for which heat exchanger 52 is configured. The preferred performance criterion established for the heat exchanger 52 requires that the temperature of the gaseous oxygen at the outlet of the heat exchanger be within 20 degrees Fahrenheit of ambient temperature when the ALOXS 10 is subjected to its maximum rated flow.

Accordingly, when there is a requirement for the system 10 to provide a flow in excess of 100 liters per minute the capacity of the heat exchanger will be increased to accommodate the higher flow rate.

The new ALOXS 10 is preferably fitted with a fill valve 32 which is compatible with home health care liquid oxygen equipment. This provides the user several options for filling the ALOXS. Being compatible with home health care equipment, system 10 can be filled by a home health care liquid oxygen provider in the same manner used to fill known 30 and 40 liter base units or conventional one liter walk-around units.

ALOXS 10 can also be filled from a regular commercial gas dewar. These dewars, commonly called LS-160's, are supplied and "traded-out" in the same manner as high pressure gas cylinders. Once delivered, all that is required to fill the ALOXS is to connect a conventional filling hose and female filler valve assembly to the dewar and connect that assembly to the ALOXS filler valve on the ambulance.

The most economical method is to fill the ALOXS 10 from a liquid oxygen bulk storage tank (not shown) such as those used in hospital supply systems. In that case, the bulk storage tank plumbing can be adapted to accommodate the filling hose and female filler valve assembly referred to above. To fill the ALOXS in such a case, the ambulance would be parked near the bulk tank and the filler valve on the ambulance would be connected to the bulk liquid oxygen supply via the filling hose and female filler valve assembly.

In use, the pneumatic circuit of ALOXS 10 is operated as follows: the ALOXS may be filled at any supply pressure within the broad range of approximately 70 to approximately 235 psig. As an example, to fill the system, the female filler valve from the liquid oxygen source is connected to filler valve 32. The supply valve from a main liquid oxygen source is opened admitting pressure to the system. Vent valve 36 is then opened and adjusted to maintain a differential pressure of approximately 30 psig between the ALOXS fill and vent circuits as indicated by differential pressure gauge 40. This allows liquid oxygen to enter the circuit and the gaseous oxygen displaced to be carefully exhausted from the system 10 through the vent.

Constructed as described, new system 10 provides a means by which to store and transport liquid oxygen and prevent the "boiling" thereof by increasing pressure (warming the oxygen), thus providing operating pressure for the system and supplying oxygen at pressures appropriate for medical uses as desired.

When the ALOXS is full, a capacitance probe (discussed above) provides a signal to the quantity indicator (tank volume) gauge 44 which triggers a preferably audible (and at least visual) full level indicator. These indicators (audible and/or visual) may be independent or incorporated directly into gauge 44 (FIG. 5), for example, and which gauge is preferred to be remotely mounted from system 10. Vent valve 36 is then closed, the supply valve from the bulk liquid oxygen source is closed, and the corresponding filler valves are disconnected.

ALOXS 10 includes a vent accumulator reservoir 38 so that any overfill of tank 26 of desirably at least three minutes duration is collected and retained in the reservoir. This feature precludes the inadvertent emission of liquid oxygen from the ambulance in the event of inattentive filling by servicing personnel. oxygen from the ambulance in the event of inattentive filling by servicing personnel.

Thus it should be understood that new liquid oxygen system 10 as described, and including any equivalents thereto, provides an extremely wide scope of potential uses due to its size and structure and the safety features discussed. Accordingly, it has already met with very widespread success in the marketplace.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A system for compactly and safely storing and delivering oxygen, the system having a plurality of elements interconnected by fluid lines and comprising:

a. a reinforced, metal, orbitally-shaped tank which receives and contains oxygen to be stored as a liquid and delivered by the system to an end user, b. a fill valve in communication with the tank for providing oxygen from a main source thereof to the system, c. a vent valve connected to the liquid oxygen tank for selectively releasing oxygen from the system, d. a differential pressure gauge located between and in communication with the fill valve and the vent valve to permit an operator of-the system to thereby monitor the pressure differential in the system so that selective adjustments can be made in a timely and controlled manner to maintain the pressure within the system during filling at an optimum level, e. at least one pressure relief valve between and in communication with the oxygen tank and the vent valve thereby release pressure from the system as necessary to maintain the desired temperature and pressure conditions within the system, f. a heat exchanger in communication with and between the liquid oxygen tank and a fluid pressure regulator, g. a fluid pressure regulator in communication with and between the heat exchanger and an oxygen flow control outlet, h. a flow control outlet by which flow of oxygen from the system to an end user can be controlled, and i. a phase selector valve disposed between and in communication with the liquid oxygen tank and the heat exchanger to thereby permit the system to select as a function of pressure whether oxygen supplied from the liquid oxygen tank to the heat exchanger will be supplied as either a liquid or a gas, the tank, fill valve, vent valve, differential pressure gauge, at least one pressure relief valve, supply heat exchanger, pressure regulator and phase selector valve all being sized and arranged in relation to one another so as to provide a light-weight, compact system for safely storing and delivering oxygen, which system is suitable for use by a home-bound patient as well as in a movable vehicle, and otherwise where safety, weight and size are of concern.

2. The system of claim 1, and further comprising a reservoir having a vent, the reservoir being connected to the vent valve and providing a means by which to accumulate overflow oxygen from the tank prior to selective release of such oxygen from the system through the vent.

3. The system of claim 1, and further comprising a tank pressure gauge for monitoring the pressure of liquid oxygen in the liquid oxygen tank.

4. A system for compactly and safely storing and delivering oxygen, the system having a plurality of elements interconnected by fluid lines and comprising:

a. a housing of sufficient size and dimensions to contain elements of the system, the housing having a floor, upstanding side walls intersecting and connected to the floor and extending upwardly therefrom, and a cover resting on upper edges of at least some of the upstanding side walls for completely enclosing the housing around portions of the system contained therein, b. a tank which receives and contains oxygen to be stored as a liquid and delivered by the system to an end user, c. a fill valve in communication with the tank for providing oxygen from a main source thereof to the system, d. a vent valve connected to the liquid oxygen tank for selectively releasing oxygen from the system, e. a differential pressure gauge located between and in communication with the fill valve and the vent valve to permit-an operator of the system to thereby monitor the pressure differential in the system so that selective adjustments can be made in a timely and controlled manner to maintain the pressure within the system during filling at an optimum level, f. at least one pressure relief valve between and in communication with the oxygen tank and the vent, to thereby release pressure from the system as necessary to maintain the desired temperature and pressure conditions within the system, g. a heat exchanger in communication with and between the liquid oxygen tank and a fluid pressure regulator, h. a fluid pressure regulator in communication with and between the heat exchanger and an oxygen flow control outlet, i. a flow control outlet by which flow of oxygen from the system to an end user can be controlled, and j. a phase selector valve disposed between and in communication with the liquid oxygen tank and the heat exchanger to thereby permit the system to select as a function of pressure whether oxygen supplied from the liquid oxygen tank to the heat exchanger will be supplied as either a liquid or a gas, the tank, fill valve, vent valve, differential pressure gauge, at least one pressure relief valve, supply heat exchanger, pressure regulator and phase selector valve all being received in and at least partly enclosed by the housing, so as to provide a safe and compact system for storing and delivering oxygen, which system is suitable for use by a home-bound patient as well as in a movable vehicle, and otherwise where safety, weight and size are of concern.

5. The system of claim 4, and further comprising a reservoir having a vent, the reservoir being connected to the vent valve and providing a means by which to accumulate overflow oxygen from the tank prior to selective release of such oxygen from the system through the vent.

6. The system of claim 5, wherein the liquid oxygen tank, vent accumulator means, and supply heat exchanger are all entirely enclosed by the housing, to thereby enhance the compactness and safety of the system.

7. The system of claim 4, and further comprising a tank pressure gauge by which the pressure of liquid oxygen within the tank can be monitored.

8. The system of claim 4, and further wherein a fill check valve is provided in a fluid line between the filler valve and the liquid oxygen tank for preventing back flow of fill oxygen.

9. The system of claim 7, wherein the differential pressure gauge is in communication with the fluid line at a point after the filler valve and before the fill check valve.

10. The system of claim 4, and further comprising a control panel mounted on the housing and disposed forwardly thereon, the fill valve, the vent valve and the differential pressure gauge being mounted on the control panel so as to be readily seen and accessed for operation by a user of the system.

11. The system of claim 4, wherein the housing is comprised of perforated metal connected at all intersections of the floor with the upstanding walls and intersections of each of the walls with any adjacent walls by metal strips, to thereby enhance the strength and durability of the housing and thus the system.

12. The system of claim 4, wherein the tank for receiving and retaining oxygen is orbitally shaped to thereby contain the largest possible amount of oxygen in the least amount of space.

13. The system of claim 4, wherein the tank is formed of a plurality of layers of metal material for increased strength and durability.

14. The system of claim 4, and further wherein the tank is provided with metal bands which completely encompass its circumference, to thereby provide increased strength to the tank.

15. The system of claim 4, wherein the tank has four legs by which it rests on the floor of the housing for enhanced stability of the tank within the housing.

16. The system of claim 4, wherein the at least one pressure relief valve comprises a high pressure relief valve and a low pressure relief valve, the high pressure relief valve and the low pressure relief valve both being connected to the fluid line between the liquid oxygen tank and the vent.

17. The system of claim 4, wherein the contents gauge is of digital readout type and is connected to a capacitance probe which for detecting the tank contents and further wherein the contents gauge includes an alarm to notify the user of the tank contents full level.

18. The system of claim 4, wherein the phase selector valve is of the automatic pressure response type.

19. The system of claim 4, and further wherein a pressure differential check valve is provided in the fluid line between the oxygen tank and the heat exchanger to thereby increase resistance in the fluid line and assure vapor flow.

20. A method for storing and delivering oxygen in a safe and convenient manner, the method comprising the steps of:

providing a compact, light-weight system having a plurality of elements interconnected by fluid lines including a housing of sufficient size and dimensions to contain elements of the system, and a cover for completely enclosing the housing around portions of the system contained therein, a liquid oxygen tank; a fill valve in communication with the tank, a vent valve connected to the liquid oxygen tank, a differential pressure gauge located between and in communication with the fill valve and the vent valve, at least one pressure relief valve between and in communication with the oxygen tank and the vent valve, a heat exchanger in communication with and between the liquid oxygen tank and a pressure regulator, a pressure regulator in communication with and between the heat exchanger and an oxygen flow control outlet, and a phase selector valve disposed between and in communication with the liquid oxygen tank and the heat exchanger; the tank, fill valve, vent valve, differential pressure gauge, at least one pressure relief valve, supply heat exchanger, pressure regulator and phase selector valve all being at least partly enclosed by the housing, providing a bulk source of oxygen from which the system may be filled, connecting the fill valve to a fluid line from the bulk source of oxygen, filling the tank with liquid oxygen via the fill valve, while simultaneously monitoring the pressure differential between the fill circuit and the fluid vent circuit by observing the differential pressure gauge, and selectively adjusting the pressure differential as necessary by manipulating the vent valve and releasing oxygen from the system, to thereby release pressure from the system as necessary to maintain the desired temperature and pressure conditions within the system during filling thereof, monitoring the volume of liquid oxygen within the tank by observing the contents gauge, automatically determining whether oxygen supplied from the liquid oxygen tank to the heat exchanger will be supplied as either a liquid or a gas by operation of the phase selector valve, and controlling the flow of oxygen from the system to an end user by use of the flow control outlet.

21. The method of claim 19, wherein the step of filling the tank includes supplying oxygen from the bulk oxygen supply at a pressure within the range of about 70 to about 235 psig and simultaneously maintaining a pressure differential of about 30 psig in the fill circuit during filling of the tank.

22. The combination of an emergency medical transport vehicle and a system for compactly and safely storing and delivering oxygen, wherein the system is conveniently and removably seated within a body of the vehicle and is connected to a control panel of the vehicle by fluid lines, the system having a plurality of elements interconnected by fluid lines and comprising:

a. a reinforced, metal, orbitally-shaped tank which receives and contains oxygen to be stored as a liquid and delivered by the system to an end user, b. a fill valve in communication with the tank for providing oxygen from a main source thereof to the system, c. a vent valve connected to the liquid oxygen tank for selectively releasing oxygen from the system, d. a differential pressure gauge located between and in communication with the fill valve and the vent valve to permit an operator of the system to thereby monitor the pressure differential in the system so that selective adjustments can be made in a timely and controlled manner to maintain the pressure within the system during filling at an optimum level, e. at least one pressure relief valve between and in communication with the oxygen tank and the vent, to thereby release pressure from the system as necessary to maintain the desired temperature and pressure conditions within the system, f. a heat exchanger in communication with and between the liquid oxygen tank and a fluid pressure regulator, g. a fluid pressure regulator in communication with and between the heat exchanger and an oxygen flow control outlet, h. a flow control outlet by which flow of oxygen from the system to an end user can be controlled, and i. a phase selector valve disposed between and in communication with the liquid oxygen tank and the heat exchanger to thereby permit the system to select as a function of pressure whether oxygen supplied from the liquid oxygen tank to the heat exchanger will be supplied as either a liquid or a gas, the tank, fill valve, vent valve, differential pressure gauge, at least one pressure relief valve, supply heat exchanger, pressure regulator and phase selector valve all being sized and arranged in relation to one another so as to provide a light-weight, compact system for safely storing and delivering oxygen, which system is suitable for use by a home-bound patient as well as in a movable vehicle, and otherwise where safety, weight and size are of concern.

* * * * *